US005079861A

United States Patent [19]

Stoudt

[11] Patent Number: 5,079,861

[45] **Date of Patent: * Jan. 14, 1992**

[54] QUICK SET-UP SIGN STAND

[76] Inventor: Theodore L. Stoudt, 16 Southwest Cellini Ct., Lake Oswego, Oreg. 97034

[ * ] Notice: The portion of the term of this patent subsequent to Jul. 2, 2008 has been disclaimed.

[21] Appl. No.: 495,722

[22] Filed: Mar. 19, 1990

[51] Int. Cl.[5] ..... G09F 7/18

[52] U.S. Cl. ..... 40/610; 40/610; 248/188.6; 248/166; 248/513

[58] Field of Search ..... 40/602, 610, 612, 606, 40/591, 607; 248/188.6–188.8, 166–538, 231.1, 624, 513–536, 512; 403/388; 108/131

[56] References Cited

U.S. PATENT DOCUMENTS

| | | | |
|---|---|---|---|
| 2,921,825 | 1/1960 | Spiegel | 248/188.6 |
| 2,991,830 | 7/1961 | Abel | 248/188.6 |
| 3,171,626 | 3/1965 | Keats | 40/607 |
| 3,677,511 | 7/1972 | Dicke | 248/166 |
| 4,038,769 | 2/1977 | Werner | 40/610 |
| 4,309,836 | 1/1982 | Knapp | 40/612 |
| 4,572,473 | 2/1986 | Seely | 248/355 |

*Primary Examiner*—Laurie K. Cranmer
*Assistant Examiner*—Cassandra L. Hope

[57] ABSTRACT

A sign stand and sign combination supported, when in use, by a pair of pivot leg assemblies secured along the bottom on the respective sides of the sign, each such assembly comprising a generally U-shaped leg having a generally linear center portion having formed therein a support locking aperture and a storage locking aperture, a leg support and a latch for engaging either the support locking aperture or the storage locking aperture for locking the leg either in a support position with the legs extending from the sign in a storage position with the legs substantially parallel to and adjacent the sign, is disclosed.

6 Claims, 2 Drawing Sheets

QUICK SET-UP SIGN STAND

BACKGROUND OF THE INVENTION

This invention relates to sign stands for display in warning purposes, such as those used at construction sites along or near highways, construction sites in or near building projects, or in buildings where repair is taking place, in parking lots and parking structures, and in merchandising generally.

The prior art is replete with hundreds, perhaps thousands, of kinds of signs and displays, and many ingenious devices and arrangements have been provided for supporting a sign in a particular location to accomplish a particular purpose, or to overcome a particular problem. One of the problems which has plagued and continues to plague the industry is the problem of storage of signs when they are not in use and the problem of the time that it takes to set up a sign for display purposes. This problem is a severe economic burden on industries where signs are taken up and stored and used again at frequent intervals, but not subject to continuous use. In construction, for example, it is common to have to move signs around on a daily or more frequent basis. In parking lot management it is necessary to set up and store signs sometimes several times a day, and not infrequently at least once a day, as a parking lot is in use, or empties or fills, or is divided for separate uses.

Many sign stands are provided which are mounted securely and firmly to the sign and which do not readily fold, or have expensive and heavy folding mechanisms. Some sign stands, for example, are built around a circular base which may be either heavy enough to support the sign and prevent it from tipping, or may have a large enough radius to prevent the sign from tipping under influences of bumping, wind, etc. Some sign stands have various types of leg folding mechanisms.

In spite of the many efforts to solve these various problems in the industry, there remains a serious need for a light-weight, compact, easily storable sign system.

In traffic situations, such as at highway construction sites, repair sites, and the like, and sometimes in merchandising circumstances, it is highly desirable to provide a flag or a number of flags on top of the sign to catch the attention of those passing by. These flag devices are particularly valuable when the sign is used in parking lots and along highways, or where the sign is subject to prevailing wind or to wind generated by moving traffic, since the waving of the flag tends to bring instantaneous attention to the sign. The same principle applies in certain merchandising situations where there is a natural wind or an artificially created wind current.

This invention is directed to a simple, inexpensive and yet effective and easy to operate set of mechanisms for solving these problems at low cost.

SUMMARY OF THE INVENTION

The present invention is a sign stand and sign combination. A generally planar sign, which may be square, rectangular, round, or any other shape, and which has an upper edge is supported, when in use, by a pair of pivot leg assemblies. One such assembly is secured along the bottom on one side of the sign, and the other such assembly is secured along the bottom on the other side of the sign. Each such assembly comprises a generally U-shaped leg having a generally linear center portion and left and right support portions extending generally in the same plane relative to each other and generally parallel to each other from the center portion, the center portion having formed therein a support locking aperture and a storage locking aperture. Leg rotation support means, which comprise elongate channel members for receiving the center portion of the leg, permit rotation of the center portion of the leg therein to thereby permit the legs to extend outwardly and/or downwardly from the sign for supporting the sign, or to lie against the sign for storage.

Latch means are provided for engaging either the support locking aperture or the storage locking aperture in the center portion of the leg for locking the leg either with the left and right support portions in support position extending from the sign for supporting the sign or with the left and right portions of the leg locked in a storage position substantially parallel to and adjacent the sign.

Latch support means support the latch and permit movement of the latch to permit the latch to engage either the support locking aperture or the storage locking aperture.

A generally V-shaped flag holder, comprising a tubular member having generally linear flag staff receiving ends and a center portion having formed therein a slot so formed as to receive the upper edge of the sign, is received, by the slot, over the upper edge of the sign with the ends extending to receive two flag staffs and secured to the sign by a pin, bolt or other fastener which may extend through aligned apertures in the holder and sign.

DESCRIPTION OF THE PREFERRED EMBODIMENT

Figure 1:
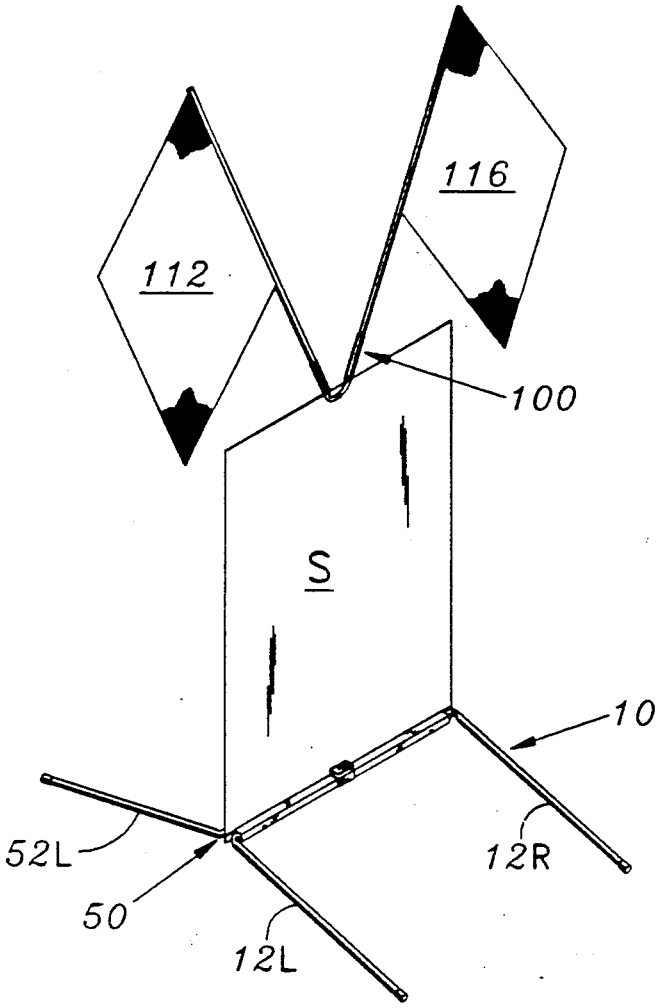
FIG. 1 is a perspective view of the sign system of the present invention.

Making reference now to the drawings, and to FIG. 1 in particular, the sign system of this invention comprises a sign S, supported by a pair of pivot leg assemblies 10 and 50, one such assembly secured along the bottom on one side of the sign and the other such assembly secured along the bottom on the other side of the sign. Each such assembly comprises a U-shaped leg, which may be of one unitary piece, or made up of several pieces. One such leg is shown partially in FIG. 1, having a left-hand extending portion 12L and a right-hand extending portion 12R, the description and function of which will be described hereinafter. A corresponding extending portion 52L of the pivot leg assembly 50 is also shown in FIG. 1.

Figure 2:
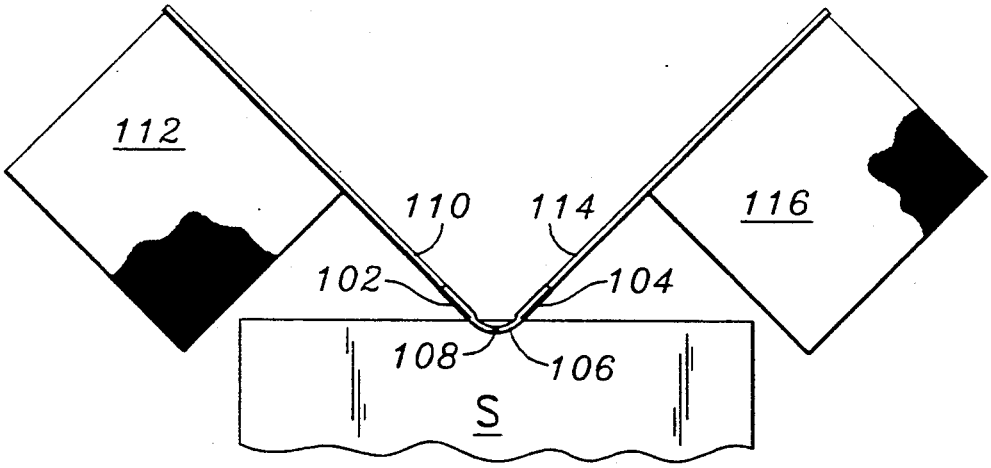
FIG. 2 is a plan view of the flag holder invention described herein.

Referring now to FIGS. 1 and 2 together, the flag holder 100 is described. The flag holder 100 comprises a tubular member having generally linear flag staff receiving ends 102 and 104, and a center portion 106 which has formed therein a slot generally diametrically transverse of the tubular holder construction. The slot is so formed as to receive the upper edge of the sign, and, in use, the flag holder is received over the upper edge of the sign with the ends extending to receive two flag staffs 110 and 114 which, in turn, support flags 112 and 116. Through the center of the V-shaped flag holder, there is, preferably, an aperture 108 which, in use, is aligned with an aperture in the upper portion of the sign S to receive a pin, bolt or other fastener to secure the V-shaped flag holder to the upper edge of the sign.

The sign is shown, in the exemplary embodiments of FIGS. 1 and 2, as being generally rectangular, but it may be square, triangular, or any other shape. It is not necessary that the top be linear, as is shown in FIGS. 1 and 2, as the same kind of sign will fit over the upper edge of a round sign or a sign having a curved upper edge.

The sign holder is made by bending a tube to form two generally equal-length linear tubular portions for receiving the flag staff, and cutting the center portion along the length of the tube to form a slot to receive the top of the sign, and drilling a hole through the flag holder perpendicular to the plane of the slot in the center of the V into which the holder is shaped. The tube is typically made of steel, and may be from as small as ½ to as large as 1½ inch in diameter, typically about ¾ to 1 inch in diameter. The two may, of course, be made of aluminum or any other material which is sufficiently strong and rigid to support the flag staff.

Figure 3:
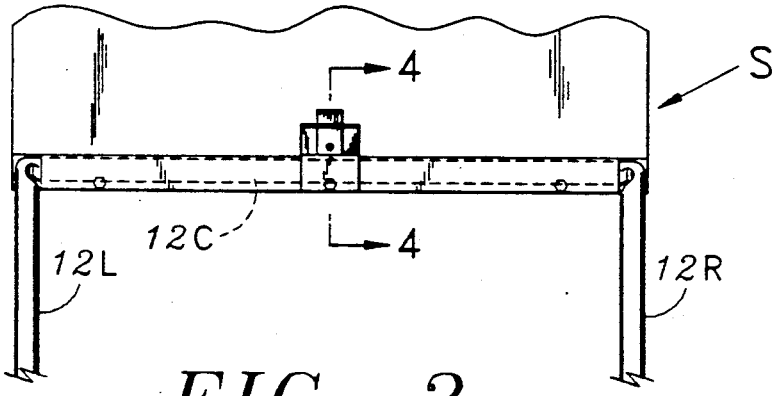
FIG. 3 is a plan view of one side of the sign support system of the present invention, showing only portions of the sign and of the legs.
Figure 4:
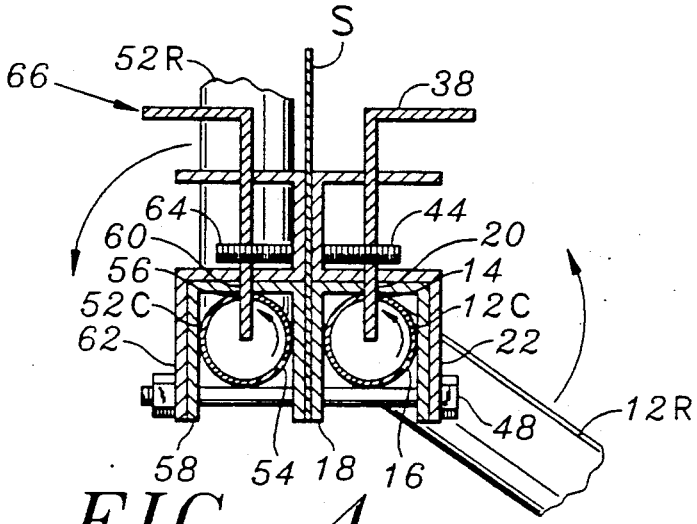
FIG. 4 is a cross-sectional view take along lines 4—4 in the direction of the arrows as shown in FIG. 3, showing in detail the structure of the leg support and pivot mechanism.
Figure 5:
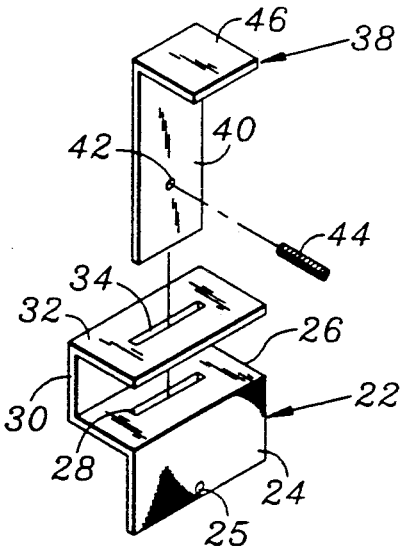
FIG. 5 is an enlarged exploded view of the latch and latch-retaining means which is shown in cross-section in FIG. 4.

Referring now to FIGS. 3, 4 and 5 in connection with FIG. 1, the pivot leg assemblies will be described. The generally planar sign S is received between a pair of pivot leg assemblies 10 and 50. One assembly 10 is secured along the bottom on one side of the sign, and the other assembly 50 is secured along the bottom on the other side of the sign, the two assemblies being secured in back-to-back or mirror-image configuration relative to each other. The relative mirror-image configuration is best shown in FIG. 4. Each of the pivot leg assemblies comprises a generally U-shaped leg having a generally linear center portion 12C and 52C respectively, and left and right support portions 12L and 12R, in assembly 10, and 52L and 52R in assembly 50. These support portions extend generally in the same plane with respect to each other and, preferably but certainly not necessarily, are generally parallel to each other as they extend from the center portion. In some embodiments, it is desirable that the support portions extend outwardly from each other within the same plane. The center portion 12C has formed therein a support locking aperture, and the center portion 52C has formed therein a support locking aperture 54. The support locking apertures are so formed in the center portions and constructed as to receive a locking latch, which will be described, for being locked in an extended position to lock the legs as they extend outwardly from the sign, in opposite directions, for supporting the sign at or above a surface.

Disposed at approximately 90° or more, typically around 100° to 110°, from the support locking aperture is a storage locking aperture 16, in center portion 12C and 56 in center portion 52C. The support locking apertures are so disposed and arranged in the center portion that when the latch is received therein, the legs are locked in a storage position extending upwardly in a plane generally parallel to the plane of the sign and closely adjacent thereto. Referring with particularity to FIG. 4, the leg 12R is shown in the support position and is locked in the support position by the latch being received in the support locking aperture. Contrariwise, the leg 52R is shown in the storage position locked therein by receiving the locking latch in the storage locking aperture 56.

Leg rotation support means 18 and 58, respectively, each comprising elongate channel members, receive the center portion of the respective legs for rotation therein. In FIG. 4, the arrow shown inside the center portion 52C, and the arrow shown on the outside of the drawing indicate the direction of rotation of the leg from the storage position to the support position. The leg rotation support means 18 and 58 have formed therein slots 20 and 60, respectively, for receiving a latch in the manner described below. Structurally, the leg rotation supports are substantially identical.

Latch mechanisms 38 and 66, respectively, are provided for engaging the support locking aperture 14 or 54, respectively, or the storage locking aperture 16 or 56, respectively, in the center portions 12C and 52C, respectively. Latch supports means 22 and 62, respectively, are provided for supporting the latches 38 and 66, respectively, in a movable relationship from the locked to an unlocked position. Latch mechanisms 38 and 66, along with stop mechanisms 44 and 64, as described below, are substantially identical in construction.

The latch support mechanism and the latch are best shown in FIG. 5 to which reference is now made. The latch support mechanism 22 is, in the preferred embodiment, a bent metal strap having a downwardly extending portion 24, having an aperture 25 therein, a rearwardly extending portion 26 having a slot 28 formed therein, an upwardly extending portion 30 and a forwardly extending portion 32, having a slot 34 formed therein, with the slots 28 and 34 being in alignment with each other and, preferably, being approximately the same size and shape. The latch 38, having a downwardly extending portion 40, with an aperture 42 therein, extends, in use, through the slot 34 and the slot 28. A set screw or other stop mechanism 44, is, in the preferred embodiment, received in the aperture 42 simply to prevent loss of the latch. The stop mechanism 44 permits the latch to move from a locked position, as shown in FIG. 4, to an unlocked position wherein the latch mechanism is lifted to remove the latch from the aperture in the center portion of the respective legs. The latch cannot be removed, however, because of the stop mechanism 44. A handle 46 is provided for convenience in operating the latch.

The latch 32 extends, when in the locked position, through the slots 34 and 28 in the latch-holding mechanism 22 and through the slot 20 in the leg rotation support means and into the slot 14, which is the support locking aperture, for locking the leg in the support position. When it is desired to fold the sign stand up, the latch 38 is lifted until the stop mechanism 44 engages the bottom of the portion 34 of the latch support means 38, at which time the bottom of the latch remains in the slot 28 and the slot 20, but not in the aperture 14. In this position, the leg 12 can be rotated, the portion 12C turning or rotating within the leg rotation support means 18, as shown in the arrow in FIG. 4, so that the leg will ultimately reach the storage position, at which time the latch locking means can be received in the aperture 16.

It is not necessary in practice to provide a locking aperture 16 to lock the aperture in the storage position, but it is a convenience.

The latch mechanism 66 and latch support mechanism 62 are identical to but mounted in a reverse or mirror-image relationship with respect to the latch 38 and latch support mechanism 22. The pivot leg assembly 50 operates in an identical manner to that just described, except to the direction of rotation of the center portion 52C.

In one embodiment, the legs are formed of steel or aluminum tubing, from about ¾ to about 1¼ inches diameter and extend from 1½ to 3 feet outwardly from the sign, depending upon the size of the sign and the degree of stability required. Obviously, the length of the legs can be varied to meet any particular support requirements. Leg extensions can be used if a particularly demanding circumstance is met. The legs can be formed as telescoping rods, for example, to be extended at will to permit the different degrees of support with simple storage and ease of use, and are also quite usable in small or crowded spaces.

The rest of the mechanism, the latch mechanism included, is generally made of steel from about 3/32 inch to about ¼ inch in thickness, depending upon the size of the sign which is to be supported and the particular support criteria. For small signs, ⅛-inch wall tubing and ⅛-inch thick steel is quite adequate. These mechanisms may, of course, be formed of aluminum, or even of titanium, if ultra light weight is required. Generally speaking, however, the greatest economy is accomplished using steel tubing and steel plates as the basic construction material.

The sign may be flexible or rigid, so long as it is sufficiently planar, or approximately planar, so as to be capable of being mounted between the pivot leg assemblies.

It will be apparent from the foregoing description and the drawings that a sign system is provided which is light in weight, is easily disassembled as to the flag holder, if desired, and is stored and equally easily unfolded and set up for use. The entire sign, in the folded position, may be stacked, hung or placed in a flat container for long-term storage, or handled in any manner with minimum damage to the sign and with minimum space occupancy.

All these advantages are accomplished at low cost and with high efficiency in the time required for setting up and storing the signs.

INDUSTRIAL APPLICATION

This invention has application in the traffic control and direction and in the merchandising display industries.

What is claimed is:

1. A sign stand and sign combination comprising:

a generally planar sign (S);

a pair of pivot leg assemblies (10, 50), one such assembly secured along the bottom on one side of the sign and the other such assembly secured along the bottom on the other side of the sign, each such assembly comprising:

a leg having a generally linear center portion (12C, 52C) and left and right support portions (12L, 52L, 12R, 52R) extending generally in the same plane from the center portion, the center portion having formed therein at least one aperture;

leg rotation support means (18, 58) for receiving the center portion of the leg for rotation therein;

latch means (38, 66) for engaging the aperture (14, 54) in the center portion of the leg for locking the leg with the left and right support portions extending from the sign for supporting the sign; and latch support means (22, 62) for supporting the latch and permitting movement of the latch from a position locking the leg with the left and right support portions extending from the sign to a position permitting the center portion to rotate in the leg rotation support means to a position wherein the legs lie substantially against the sign.

2. The sign stand and sign combination of claim 1 wherein the center portion of the leg (12C, 52C) has formed therein a second aperture for receiving the latch means and wherein the latch means and second aperture are so formed and constructed that when the latch means is received in the second aperture the left and right portions of the leg (12L, 52L, 12R, 52R) are locked in a storage position substantially parallel to and adjacent the sign.

3. A sign stand and sign combination comprising:

a generally planar sign (S);

a pair of pivot leg assemblies (10, 50), one such assembly secured along the bottom on one side of the sign and the other such assembly secured along the bottom on the other side of the sign, each such assembly comprising:

a generally U-shaped leg having a generally linear center portion (12C, 52C) and left and right support portions (12L, 52L, 12R, 52R) extending generally in the same plane and generally parallel to each other from the center portion, the center portion having formed therein a support locking aperture (14, 54) and a storage locking aperture (16, 56);

leg rotation support means (18, 58) comprising elongate channel members for receiving the center portion of the leg for rotation therein;

latch means (38, 66) for engaging either the support locking aperture (14, 54) or the storage locking aperture (16, 56) in the center portion of the leg for locking the leg either with the left and right support portions in support position extending from the sign for supporting the sign or with the left and right portions of the leg locked in a storage position substantially parallel to and adjacent the sign; and latch support means (22, 62) for supporting the latch and permitting movement of the latch to permit the latch to engage either the support locking aperture or the storage locking aperture.

4. A sign and flag holder comprising:

a generally planar sign having an upper edge;

a generally V-shaped flag holder formed from a single tubular member having generally linear flag staff receiving ends and a center portion having formed therein a slot so formed as to receive the upper edge of the sign;

the slot in the flag holder being received over the upper edge of the sign with the ends extending to receive two flag staffs; and means securing the flag holder to the sign.

5. The sign and flag holder of claim 5 wherein the flag holder has formed therein an aperture therethrough and the sign has formed therein an aperture therethrough adjacent the upper edge thereof, said apertures being aligned, and the means for securing the flag holder to the sign comprises an elongate securing pin extending through the apertures in the holder and the sign.

6. A sign system comprising:

a generally planar sign (S) having an upper edge;

a pair of pivot leg assemblies (10, 50), one such assembly secured along the bottom on one side of the sign and the other such assembly secured along the bottom on the other side of the sign, each such assembly comprising:

a leg having a generally linear center portion (12C, 52C) and left and right support portions (12L, 52L, 12R, 52R) extending generally in the same plane from the center portion, the center portion having formed therein at least one aperture;

leg rotation support means (18, 58) for receiving the center portion of the leg for rotation therein;

latch means (38, 66) for engaging the aperture (14, 54) in the center portion of the leg for locking the leg with the left and right support portions extending from the sign for supporting the sign;

latch support means (22, 62) for supporting the latch and permitting movement of the latch from a position locking the leg with the left and right support portions extending from the sign to a position permitting the center portion to rotate in the leg rotation support means to a position wherein the legs lie substantially against the sign;

a generally V-shaped flag holder (100) comprising a tubular member having generally linear flag staff receiving ends (102, 104) and a center portion (106) having formed therein a slot so formed as to receive the upper edge of the sign (S);

the slot in the flag holder being received over the upper edge of the sign with the ends extending to receive two flag staffs; and means (108) securing the flag holder to the sign.

* * * * *